US010551057B2

(12) United States Patent
Trochou et al.

(10) Patent No.: US 10,551,057 B2
(45) Date of Patent: Feb. 4, 2020

(54) GAS BURNER WITH MULTIPLE RINGS OF FLAMES HAVING TWO PARALLEL VENTURIS, ONE ABOVE THE OTHER

(71) Applicant: SOCIETE NOUVELLE SOURDILLON, Veigne (FR)

(72) Inventors: Christophe Trochou, Veigne (FR); Fabienne Mereau, Veigne (FR); Gilles Mongay, Veigne (FR)

(73) Assignee: SOCIETE NOUVELLE SOURDILLON, Veigne (FR)

( * ) Notice: Subject to any disclaimer, the term of this patent is extended or adjusted under 35 U.S.C. 154(b) by 62 days.

(21) Appl. No.: 15/780,127

(22) PCT Filed: Nov. 30, 2015

(86) PCT No.: PCT/FR2015/053260

§ 371 (c)(1),
(2) Date: May 30, 2018

(87) PCT Pub. No.: WO2017/093615

PCT Pub. Date: Jun. 8, 2017

(65) Prior Publication Data

US 2018/0347808 A1 Dec. 6, 2018

(51) Int. Cl.
*F23D 14/06* (2006.01)
*F24C 3/08* (2006.01)

(52) U.S. Cl.
CPC ..... *F23D 14/06* (2013.01); *F24C 3/08* (2013.01)

(58) Field of Classification Search
CPC ..... F23D 14/06; F23D 14/065; F23D 2900/14062

(Continued)

(56) References Cited

U.S. PATENT DOCUMENTS 5,154,598 A * 10/1992 Gooderham ..... F23D 14/02 431/188
2010/0233643 A1 9/2010 Biagioli et al.

FOREIGN PATENT DOCUMENTS

| | | |
|---|---|---|
| CH | 177 397 | 5/1935 |
| EP | 1120603 | 8/2001 |
| EP | 2 053 309 | 4/2009 |

OTHER PUBLICATIONS

International Search Report issued in PCT/FR2015/053260 dated Aug. 5, 2016.
Written Opinion issued in PCT/FR2015/053260 dated Aug. 5, 2016.

* cited by examiner

*Primary Examiner* — Avinash A Savani
*Assistant Examiner* — Rabeeul I Zuberi
(74) *Attorney, Agent, or Firm* — DLA Piper LLP US

(57) ABSTRACT

A gas burner with multiple rings of flames, suitable for mounting on a top plate of a cooking appliance in particular for household use. The top plate extends substantially in a plate plane. The gas burner includes a central burner having a ring of peripheral flames and at least one annular burner having at least one ring of peripheral flames. The annular burner surrounds the central burner. The gas burner also includes a burner body suitable for attachment to the top plate. The burner body includes at least a first gas inlet communicating with a first gas injector situated facing a first convergent-divergent pipe forming a Venturi tube. The first pipe has an axis substantially parallel to said plate plane. The first pipe extends over at least the greater portion of a transverse extension of the burner body. The first pipe is, at its end opposite to the first gas injector, in communication with a shaft substantially perpendicular to the axis of the first pipe. The shaft is open at the top and adapted to supply the annular burner with an air/gas mixture. The burner body (Continued)

includes a second pipe forming a Venturi tube, its axis parallel to the axis of the first pipe and situated above the first pipe. The second pipe has one end in communication with an opening at the top of the burner body, adapted to supply the central burner with an air/gas mixture.

19 Claims, 8 Drawing Sheets

(58) Field of Classification Search
USPC ..... 431/8, 12, 278, 284, 285, 349, 350, 354; 137/205.5, 892, 896
See application file for complete search history.

GAS BURNER WITH MULTIPLE RINGS OF FLAMES HAVING TWO PARALLEL VENTURIS, ONE ABOVE THE OTHER

CROSS REFERENCE TO RELATED APPLICATIONS

This application is a U.S. National Stage Application of International Application No. PCT/FR2015/053260 filed Nov. 30, 2015. The entirety of all the above-listed applications are incorporated herein by reference.

The invention relates to assemblies formed by a top plate of a cooking appliance, in particular for household use, and to gas burners with multiple rings of flames which are adapted to be mounted on such a plate.

Such burners generally comprise a central burner and an annular burner surrounding the central burner.

Such burners are used when significant heat output is required, and/or in conjunction with respective devices supplying gas to the central and annular burners, when regulation of the heat output is required (Asian cuisine for example).

Burners are already known that have multiple rings of flames provided with a central burner having a ring of peripheral flame, and an annular burner surrounding the central burner and provided with one or two rings of flames: an inner ring of flame and an outer ring of flame. The annular burner may also comprise only one outer ring of flame.

Document EP 1120603 for example describes such burners.

At the origin of the invention, we sought rendering the assembly described in that document more compact, and to further improve the performance of such burners.

Indeed, although the document states that the structure it describes is compact, it has been found that it is not sufficiently compact for mounting on a cooktop plate having a thickness of slightly more than 4 cm.

The invention therefore aims to propose a gas burner with multiple rings of flames of an improved type, having a structure allowing its placement on a conventional stove as well as on a cooktop plate of low thickness (less than 3 cm).

To this end, the invention concerns a gas burner with multiple rings of flames, suitable for mounting on a top plate of a cooking appliance in particular for household use, the top plate extending substantially in a plate plane, said gas burner comprising:

- a central burner having a ring of peripheral flames and at least one annular burner having at least one ring of peripheral flames, said annular burner surrounding the central burner,
- and a burner body suitable for attachment to said top plate, said burner body comprising at least a first gas inlet communicating with a first gas injector situated facing a first convergent-divergent pipe forming a Venturi tube, said first pipe having an axis substantially parallel to said plate plane, said first pipe extending over at least the greater portion of a transverse extension of the burner body,
- said first pipe being, at its end opposite to said first gas injector, in communication with a shaft substantially perpendicular to said axis of said first pipe, said shaft being open at the top and adapted to supply said annular burner with an air/gas mixture.

The burner according to the invention is noteworthy in that said burner body comprises a second pipe forming a Venturi tube, its axis parallel to the axis of the first pipe and situated above said first pipe, said second pipe having one end in communication with an opening at the top of the burner body, adapted to supply said central burner with an air/gas mixture.

With this adopted structure, a burner is formed having multiple rings of flames in which the mixture of gas and air streams passing through the first Venturi tube and supplying the outer burner head is also used to supply the inner burner head, because the Venturi tube supplying the inner burner head communicates with the Venturi tube of the outer burner head. This optimizes the space occupied by the burner body.

Additionally, by horizontally orienting the Venturi tube supplying the inner burner head and by positioning the two Venturi tubes atop one another, the height occupied by the assembly is reduced, thereby creating assemblies of reduced vertical footprint, which can be mounted on a cooktop plate of reduced thickness.

Also, by horizontally orienting the Venturi tube supplying the inner burner head, one can increase the length of the Venturi tube (and therefore the performance of the inner burner head) without affecting the vertical footprint of the assembly.

The assembly according to the invention may also comprise the following characteristics, taken separately or in combination:

- The second pipe may comprise a second open end in said shaft, such that the air/gas mixture from said first pipe also flows in said second pipe. This enables the use of a single gas inlet to supply both the central and annular burners.
- The burner body may comprise a second gas inlet communicating with a second gas injector situated facing the second pipe forming a Venturi tube, the second gas injector being positioned at a second end of said second pipe forming a Venturi tube, said second end being opposite said end in communication with the opening at the top of the burner body, said second gas injector being oriented parallel to said first gas injector.
- The central burner and the annular burner may each respectively comprise a central burner head and an annular burner head, and respectively a central burner cap and an annular burner cap.
- The central burner head and the annular burner head may be made as one part. This facilitates assembly of the burner.
- The central burner head assembled to the burner body may form a passage parallel to the axis of the first and second pipes forming Venturi tubes, the passage possibly having a passage inlet formed by the opening at the top of the burner body and a passage outlet which opens substantially into the center of the central burner head.
- Upstream of the second pipe forming a Venturi tube, the burner body may form, with the central burner head, an air intake chamber around said second gas injector.
- Said second gas inlet may open into said air intake chamber in proximity to said second gas injector.
- The annular burner head may comprise an annular chamber bordered at least unilaterally by flame outlet openings and having at its bottom an opening in communication with said shaft. In addition, the central burner head may comprise a central burner chamber having an opening adapted to communicate with the opening at the top of the burner body.
- In proximity to said at least first gas inlet, the burner body may comprise an air intake opening in proximity to the inlet of said first pipe forming a Venturi tube.

The annular burner may be surrounded at the base by a downwardly inclined peripheral skirt, the peripheral skirt preferably being removable.

The burner may comprise at least one flame detection thermocouple and/or at least one electric ignition member, and said at least one thermocouple and/or said at least one electric ignition member may be operatively associated with the central burner.

The invention also relates to an assembly comprising at least one gas burner as defined above and a cooktop plate.

According to one advantageous embodiment, the axis of the first pipe is positioned below the plate plane of the cooktop plate, and the axis of the second pipe is positioned above the plate plane of the cooktop plate. When so implemented, the assembly occupies a much smaller height than those of known assemblies.

According to an alternative embodiment, as well, the second pipe is enclosed between the cooktop plate on the one hand and the central burner and annular burner on the other hand. With this arrangement, the second pipe is protected from soiling, which facilitates cleaning the assembly.

According to yet another advantageous embodiment, the assembly comprises at least one primary air intake located below the plate.

The invention will be better understood from reading the following detailed description of some embodiments given by way of non-limiting examples. This description refers to the accompanying drawings, wherein.

In the following description, the terms "lower," "upper", "top", "bottom", etc. are used in reference to the drawings for greater ease of understanding. They are not to be understood as limitations to the scope of the invention.

Reference will first be made to a first embodiment illustrated in FIGS. 1 to 5.

Figure 6:
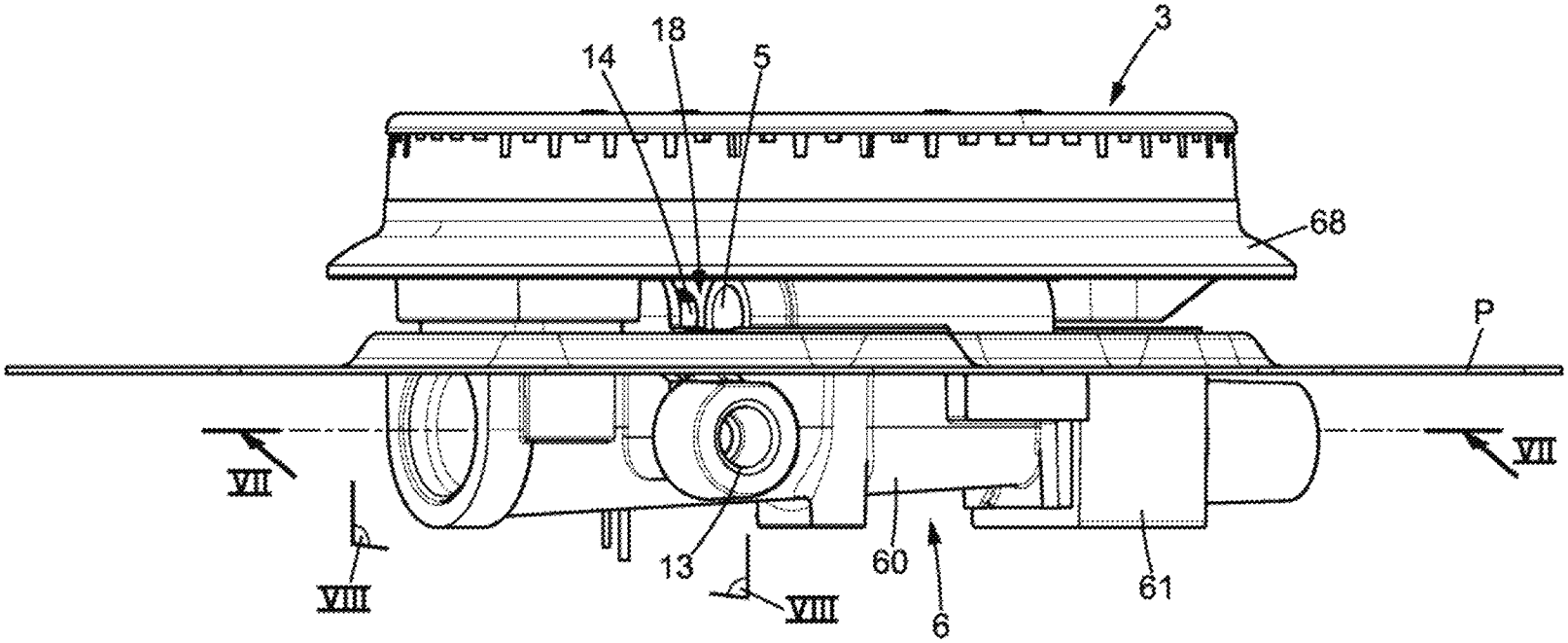
FIG. 6 is a perspective view of an assembly according to a second embodiment of the invention.
Figure 7:
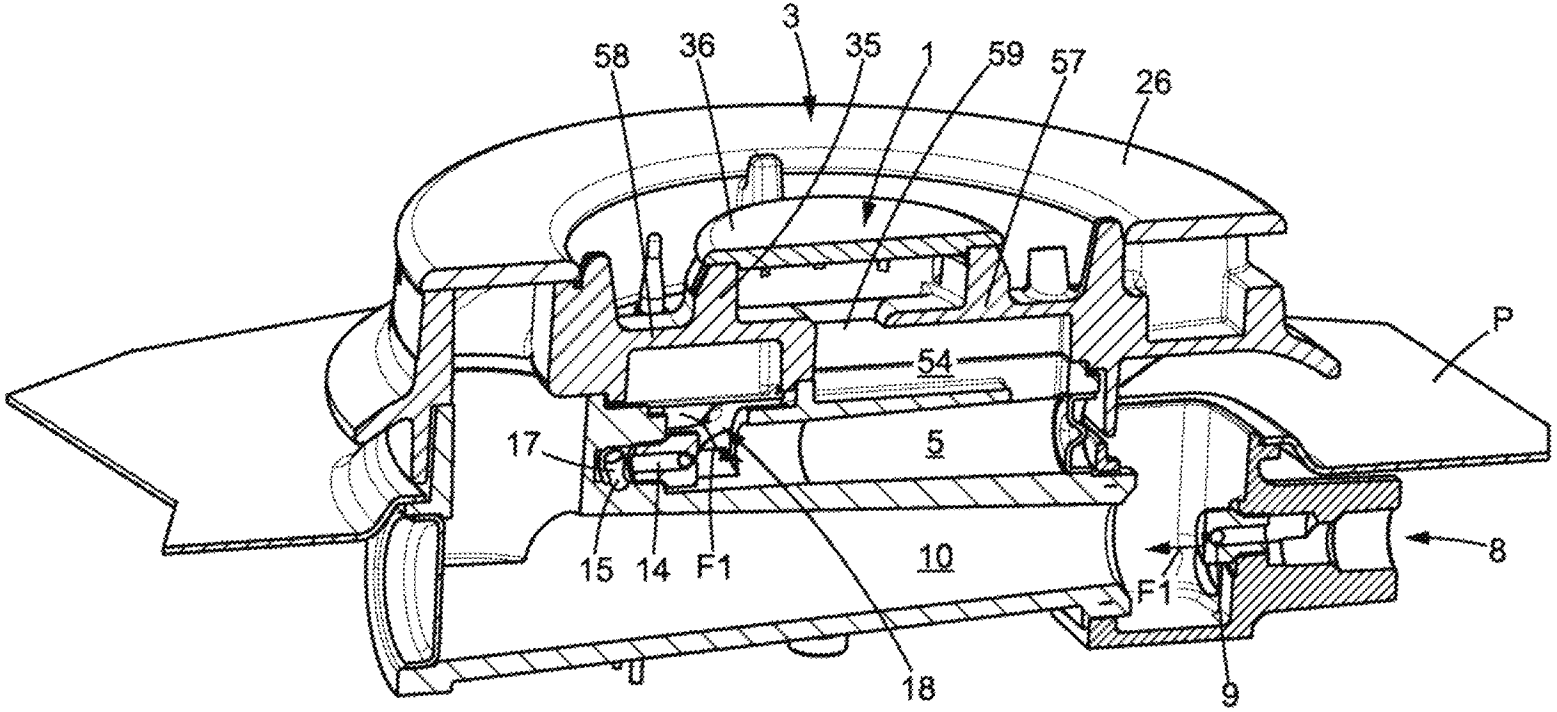
FIG. 7 is a longitudinal sectional view along plane VII-VII shown in FIG. 6.
Figure 8:
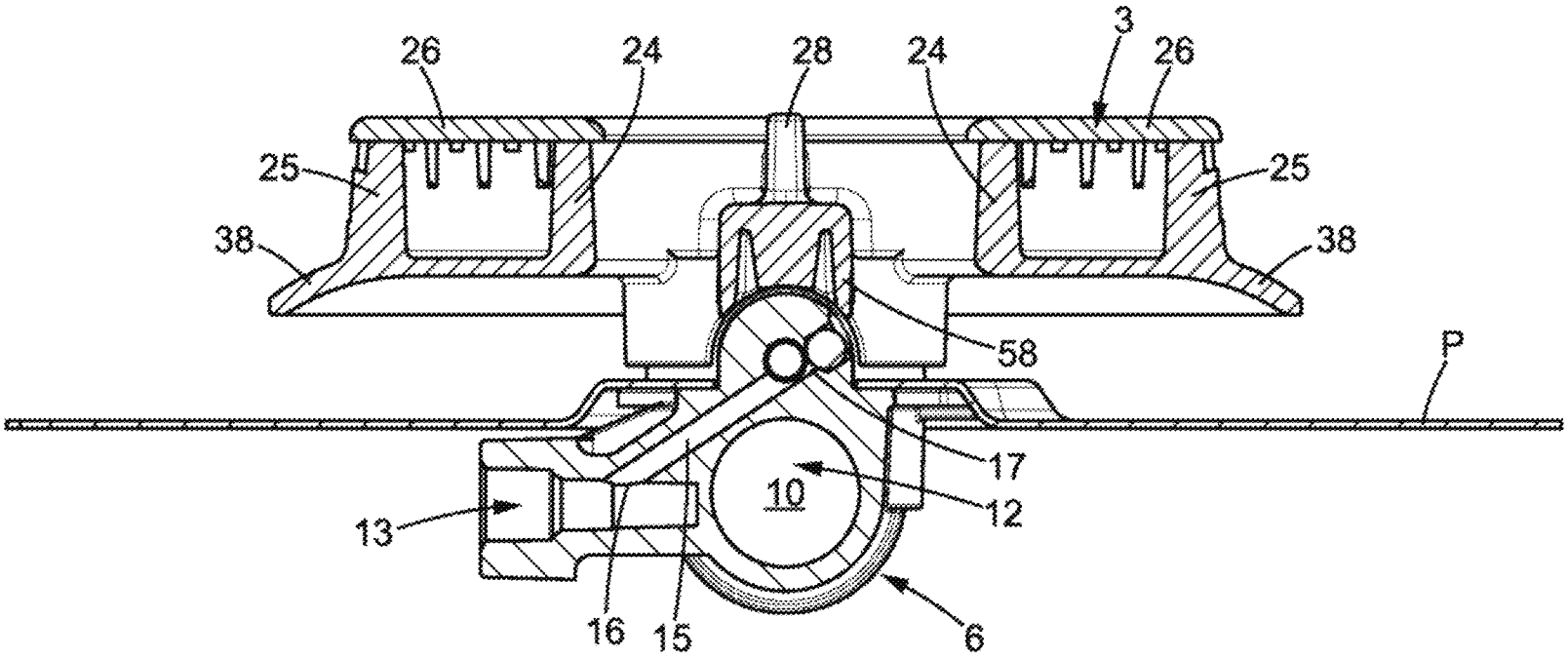
FIG. 8 is a transverse sectional view along plane VIII-VIII shown in FIG. 6.

The second embodiment illustrated in FIGS. 6 to 8 will then be described.

Figure 1:
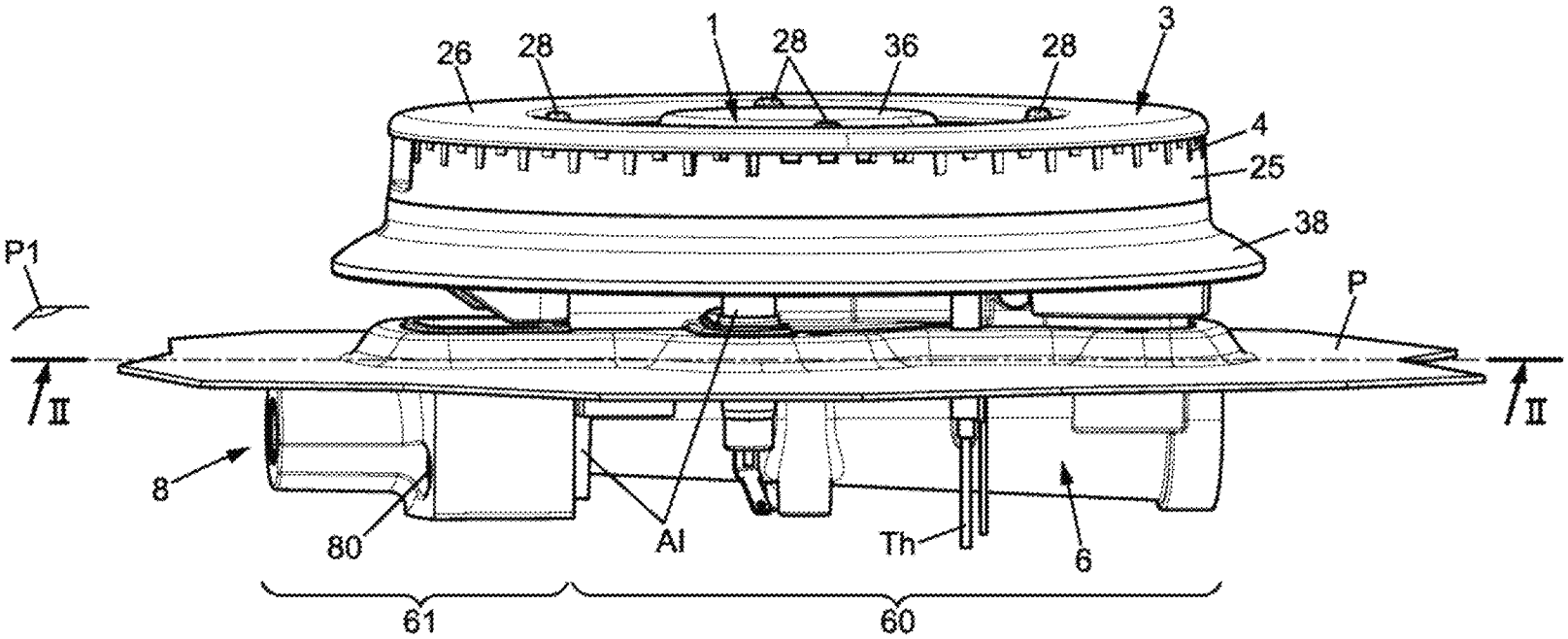
FIG. 1 is a perspective view of an assembly according to a first embodiment of the invention.

First referring to FIG. 1, the assembly comprises a gas burner comprising an inner burner head 1 (or central burner) which is in a central position, having a peripheral ring of flames (flame outlet openings 2) and at least one outer burner head 3 (or annular burner) which is annular and surrounds the central burner head 1 at a distance, having at least one inner and/or outer ring of flames. In the example illustrated in all the figures, the annular outer burner head 3 has an outer ring of flames (flame outlet openings 4).

It should be noted that the two embodiments illustrated and presented in FIGS. 1 to 8 have the same burner heads 1 and 3.

Moreover, in both embodiments presented, the inner 1 and outer 3 burner heads are created as one part. This has the advantage of reducing the number of parts comprised in the assembly according to the invention.

The inner 1 and outer 3 burner heads thus form one part which, by means of a burner body 6, is suitable for mounting on a cooktop plate P.

The cooktop plate P is for example a stovetop or cooktop. It is visible in the drawings of FIGS. 1 to 3. The cooktop plate P extends substantially along a plate plane P1.

Figure 2:
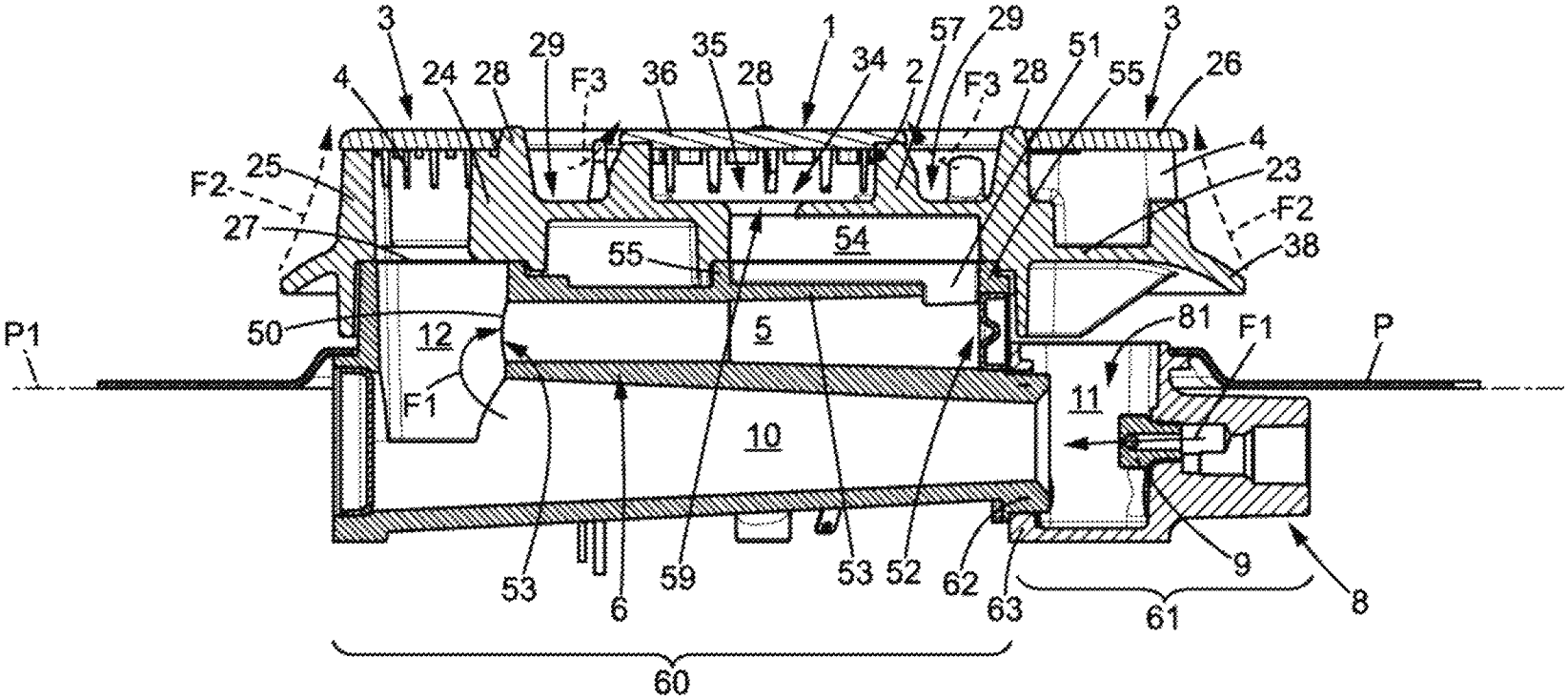
FIG. 2 is a sectional view of the assembly, along plane II-II shown in FIG. 1.
Figure 4:
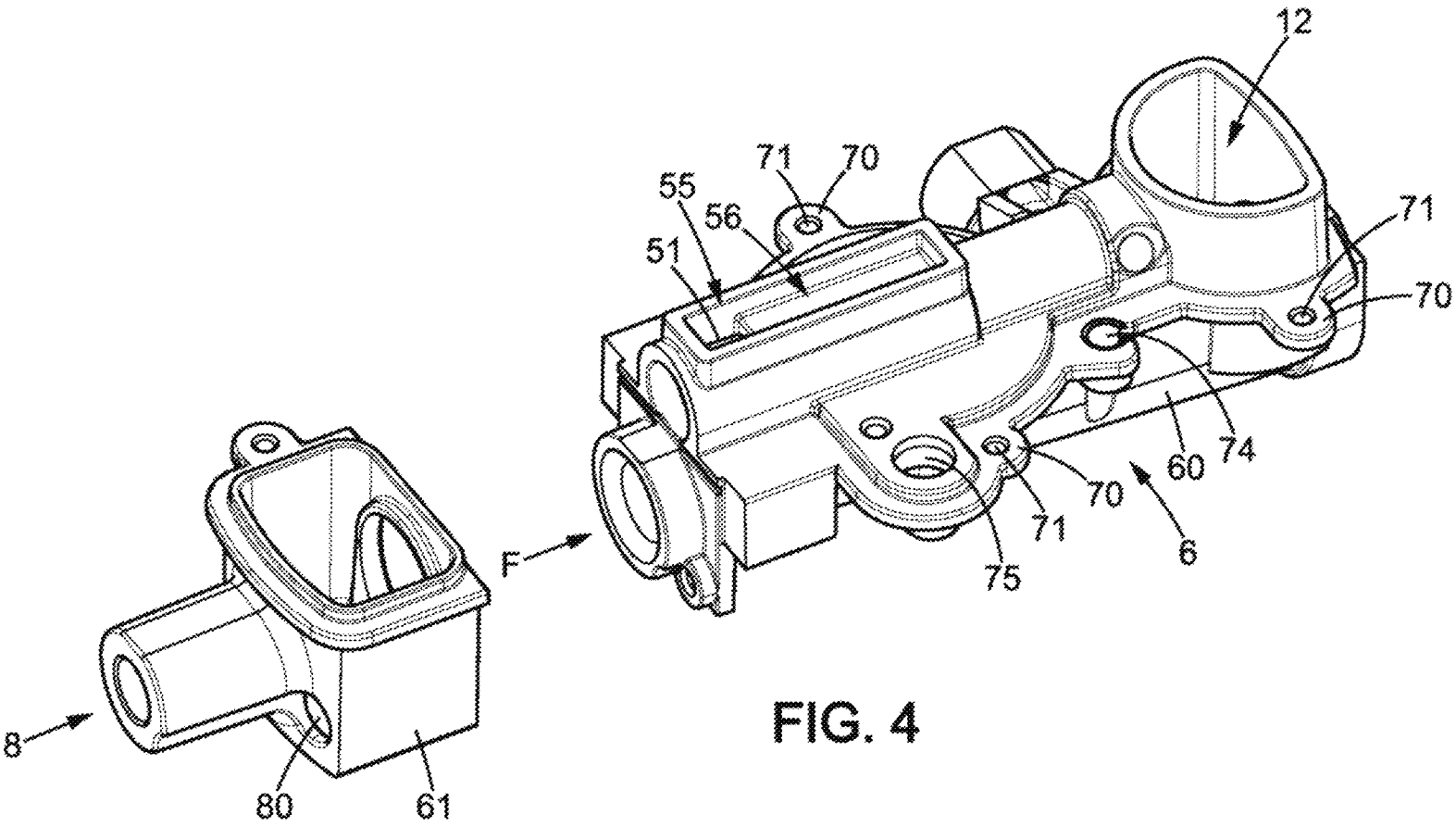
FIG. 4 is an enlargement of part IV indicated in FIG. 3, showing a perspective view of the burner body of the assembly shown in FIGS. 1 to 3.

The burner body 6 is visible in particular in FIGS. 1, 2 and 4. Here the burner body 6 has a relatively elongated shape, substantially corresponding to the diameter of the outer burner head 3 which is mounted atop said body.

The burner body 6 is arranged to be secured, by fastening means, at least partly under the cooktop plate P of a cooking appliance.

FIG. 4 shows in particular that the burner body 6 is surrounded at least partially and substantially at mid-height, by a securing flange 70 having occasional holes 71.

Figure 3:
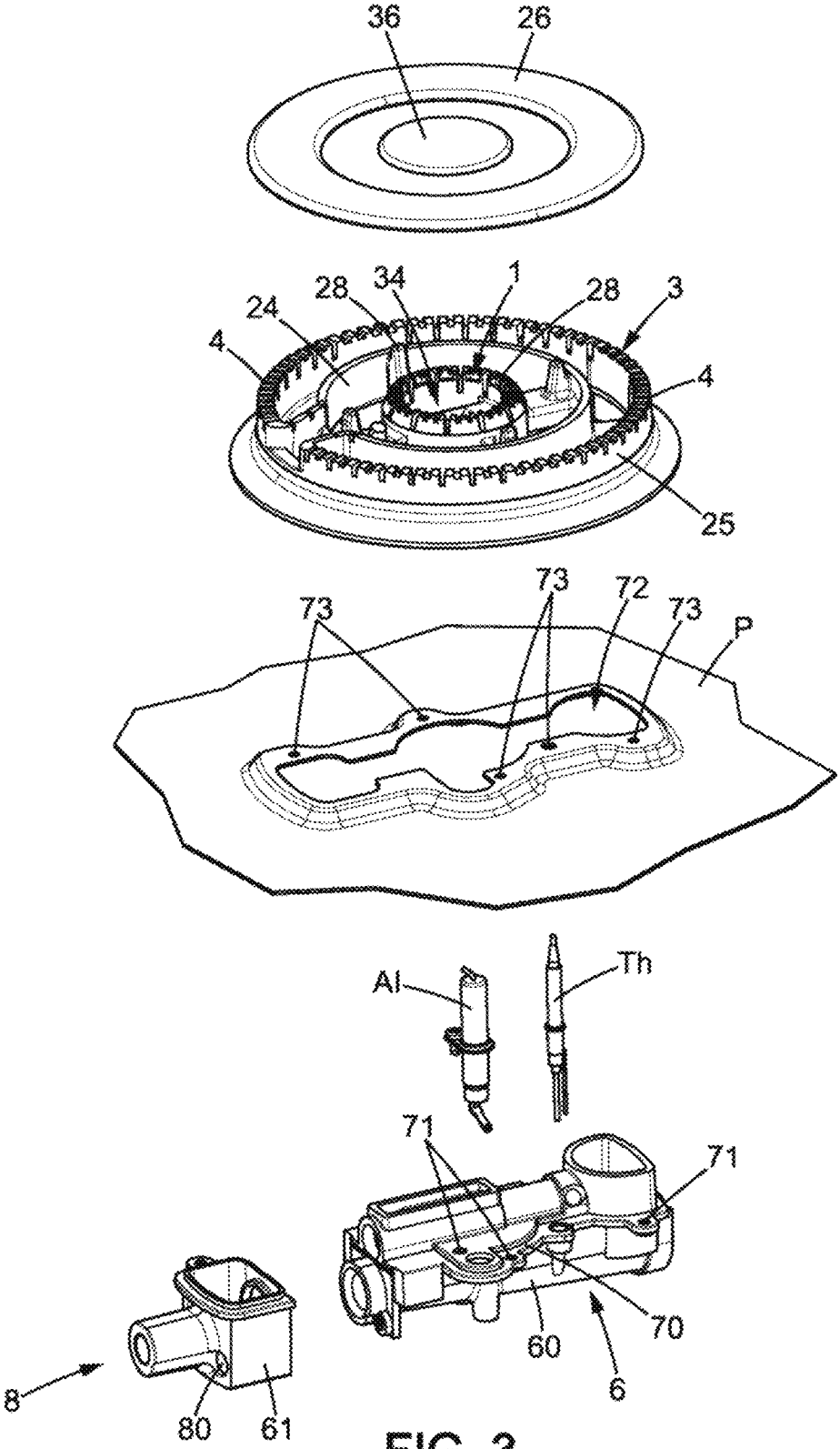
FIG. 3 is an exploded view of the assembly shown in FIG. 1.

The cooktop plate P has a cutout 72 substantially corresponding to the shape of the cross-section of the burner body 6, in order to accommodate the burner body 6 (FIG. 3).

Holes 73 are also pierced around the cutout 72. Some holes 73 are in vertical alignment with the holes 71 of the flange 70 of the burner body when the latter is positioned in the cutout 72 of the cooktop plate P.

Fastening means, such as nuts and bolts (not shown) placed in the holes 71 and 73, secure the burner body 6 to the cooktop plate P.

At one end of the burner body 6 is a gas inlet 8, which is connectable to a gas supply via control means (not shown) which preferably are specific to it.

As can be seen in FIG. 2, the gas inlet 8 is in communication with a gas injector 9 positioned coaxially and facing one end of a pipe 10 which is first convergent and then divergent and forming a Venturi tube, which extends substantially over the greater portion of the length of the burner body 6, in other words the diameter of the outer burner head 3, along an axis parallel to the plane P1.

Between the gas injector 9 and the pipe 10 there is a primary air intake port 11. The primary air intake port is supplied with air by a through-hole 80 and/or by the opening 81 formed across the body of the burner 6, adjacent to the gas injector 9.

More specifically, in the context of the illustrated example, the burner body 6 is made of two portions that can be assembled together: a first portion 60 which comprises the pipe 10, and a portion 61 having a housing for receiving the injector and which can be assembled to one end of portion 60, facing the inlet to the pipe 10. The arrow F in FIG. 4 shows where to position part 61 relative to part 60 in order to assemble them together.

FIG. 2 shows that the end 62 of part 60 fits into the end 63 of part 61.

It should be noted that parts 60 and 61 could be made as one part.

At its terminus, the pipe 10 is connected to a substantially vertical shaft 12 bringing the air-gas mixture into the outer burner head 3.

As can also be seen in FIG. 2, the burner body 6 comprises a second pipe 5 forming a Venturi tube, which extends parallel to pipe 10, also extending substantially over a portion of the length of the burner body 6. The second pipe 5 is arranged above pipe 10 and in the opposite direction: the inlet 50 into the pipe 5 occurs from the shaft 12 and the outlet from the second pipe 5 occurs via an opening 51 formed in the top of the pipe 5, near its end 52 opposite the end 53 comprising the inlet 50 of the second pipe 5.

When so implemented, the second pipe 5 communicates with the shaft 12 and the air/gas mixture flowing through pipe 12 is also caught in the second pipe 5 wherein it also flows.

The outlet opening 51 of the second pipe 5 leads to a passage 54 which opens substantially into the center 59 of the central burner head 1, thereby leading the air/gas mixture to the central burner head 1.

It should be noted that in an alternative embodiment, there could be more outlets 51 leading to the passage 54.

Reference will now be more specifically made to the inner 1 and outer 3 burner heads, with reference to FIGS. 1, 2, 3 and 5.

The outer burner head 3 comprises an annular chamber 22 situated adjacent to the outer periphery of this head. The chamber 22 is formed by a channel defined by a bottom 23 and two concentric side walls 24, 25, and by an annular cap or cover 26 capping said channel (FIG. 1). Slots are made in the wall 25, forming flame outlet openings 4.

In the example illustrated, the slots forming the flame outlet openings are of different depths in order to enable better combustion and a resistant ring of flames.

Figure 5:
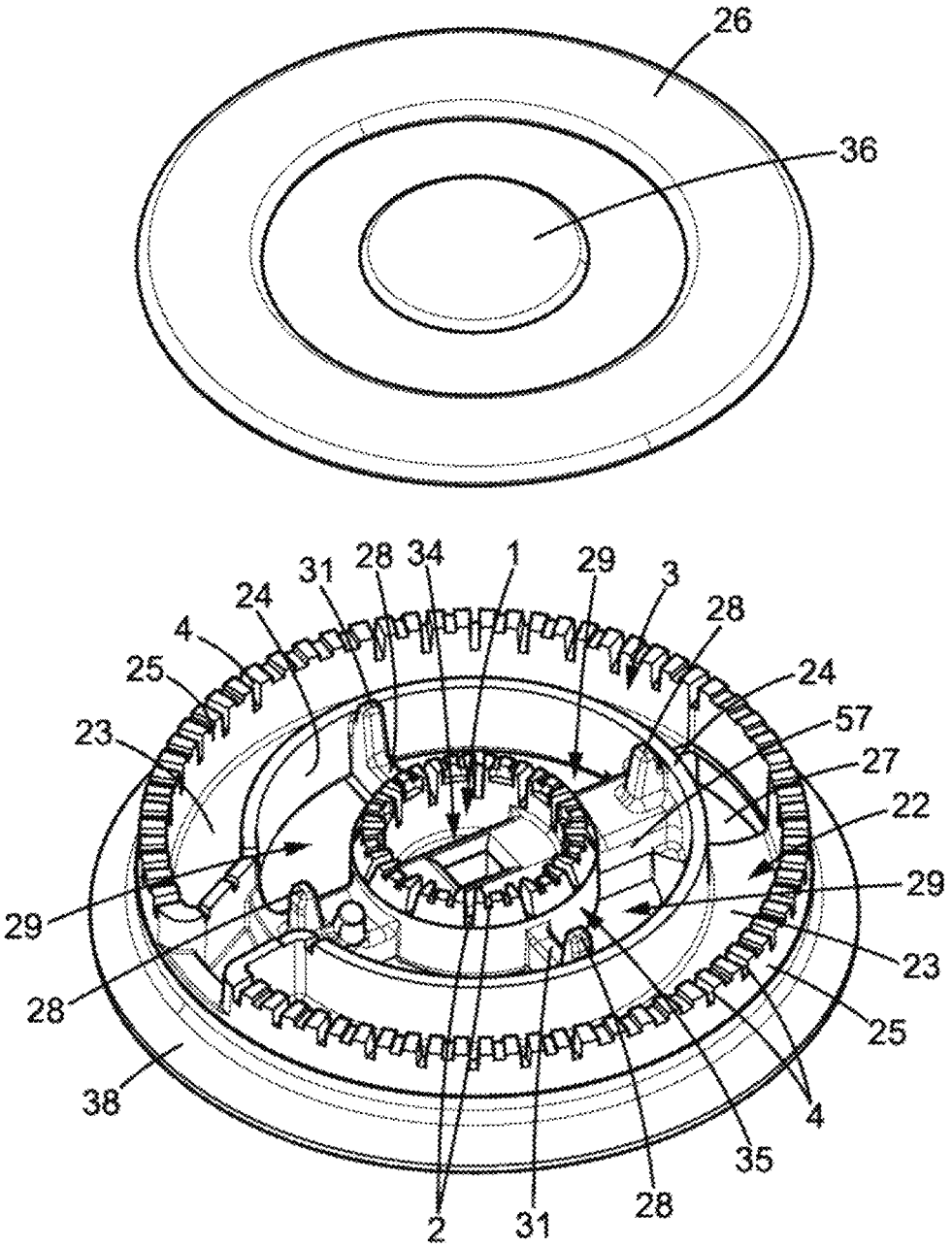
FIG. 5 is an enlargement of part V indicated in FIG. 3, showing a perspective view of the burner heads of the assembly shown in FIGS. 1 to 3.

As can be seen in particular in FIG. 5, the bottom 23 of the chamber has an opening 27, which is positioned facing the (aforementioned) substantially vertical shaft 11 of the burner body 6 when the assembly is assembled (FIG. 2).

As can be seen in particular in FIG. 2, the annular cap 26 is guided during placement and is held in position by positioning pins 28 integral with the outer burner head 3.

As in FIG. 5, the outer burner head 3 is arranged so that, between a central region which will be discussed further below and the annular chamber 22, it comprises ports 29 which perforate this intermediate annular zone.

Finally, the outer burner head 3 is integral with the central burner head 1 at least by means of bridges 31 formed between the central burner head 1 and a positioning pin 28, integral with concentric side wall 24 of the outer burner head 3.

More specifically, the central inner burner head 1 has a central region comprising a central opening 34.

The central opening is coincident with the outlet of the abovementioned passage 54, which guides the air/gas mixture exiting the second pipe 5 towards a central region of the central inner burner head 1.

More specifically, the passage 54 is formed partly by the upper portion of the burner body 6 having projections, and partly by a portion of the central burner head assembled to the burner body 6.

FIG. 4, illustrating the burner body 6, shows a rectangular projecting portion 55 provided on the upper part of the burner body 6.

The outlet end 51 of the second pipe 5 forming a Venturi tube is located inside the space defined by the rectangular projecting portion.

The solid bottom 56 of the interior space defined by the rectangular projecting portion 55 is formed by the wall of the burner body and is located substantially at the same level as that of the outlet end 51 of the second pipe 5.

The solid bottom 56 forms the bottom of the passage 54.

The side walls of the passage 54 are formed in part by the rectangular projecting portion 55, and by the side walls of a parallelepiped hollow portion 57 which connects side wall 24 of the outer burner 3 and the inner burner 1.

Thus, when the central (or inner) burner head 1 is assembled to the burner body 6, the passage 54 is formed between the rectangular projecting portion 55 and the parallelepiped hollow portion 57.

The passage 54 has an axis parallel to the axis of the first and second pipes 10 and 5 (respectively) and comprises:

- a passage inlet, formed by an opening at the top of the burner body 6 corresponding to the outlet of the second pipe 5, and
- a passage outlet, which opens substantially into the center of the central burner 1, so that the air/gas mixture from the shaft 12 is delivered to the center of the inner central burner 1.

The central burner head 1 comprises a peripheral wall 35 which is pierced with slots 2 of different depths, forming flame outlet openings (see FIGS. 3 and 5 in particular). A cap or cover 36 rests on the wall 35 (see FIG. 1).

Finally, one will note that the outer burner head 3 is, as is often the case for gas burners, bordered at the bottom by an annular peripheral skirt 38 inclined downward. This skirt may be an integral part of the burner head 3, or may be an annular part removably attached to the burner head 3: the annular part 38 may be guided into position by suitable shoulders, for example.

In addition, it is then easy to shape and/or decorate this annular part in various ways in order to meet commercial requirements for example.

The structural arrangements just described result in a gas burner with multiple rings in which the burner heads 1 and 3 function with only one gas supply. By having intercommunication between the two pipes forming Venturi tubes, it is possible to supply two different burner heads. By arranging the two pipes forming Venturi tubes parallel to each other and one above the other, parallel to the plane P1 of the cooktop plate P, the burner body is housed in a space of reduced height and width.

It will also be noted that the burner body 6, when attached to the cooktop plate P, occupies space above the cooktop plate P and space below the cooktop plate P, which further reduces the footprint of the burner body beneath the cooktop plate P and allows installing the burner body in very small spaces, for example beneath a cooktop plate of reduced thickness (less than 3 cm).

In FIG. 2, the arrows F1 schematically indicate the path followed by the primary air which, from opening 80 (air coming from below the cooktop plate P) or from the upper end of the primary air intake port 11 (air coming from above the cooktop plate P), reaches the inlet of pipe 10, and simultaneously traverses the shaft 12 and reaches pipe 5.

As for the secondary air which must reach the feet of the flames, its paths are schematically indicated by the dashed arrows F2. It partly comes from outside the burner for the ring of outer flames, and from the external air arriving through the openings 29 (arrows F3) for the ring of inner flames of the central burner 1.

Finally, one will note that, in order to simplify the structure of the burner and reduce its cost, a single thermocouple Th and/or a single electric ignition member A I are provided, which are then operatively associated with the single central burner.

As can best be seen in FIG. 4, the burner body 6 comprises housings 74 and 75 in its fastening flange 70 for respectively accommodating at least one thermocouple Th and at least one electric ignition member A I.

Reference will now be made to a second embodiment, shown in FIGS. 6 to 8.

The same references are used to denote the elements common to both embodiments.

The second embodiment comprises the same burner heads 1 and 3 formed as one part and the same plate P as the assembly shown in FIGS. 1 to 5.

It also has substantially the same burner body 6, because it comprises the gas inlet 8, the injector 9, and the two pipes 10 and 5 forming Venturi tubes. However, the burner body 6 of this second example has specific characteristics that the burner body 6 of the first embodiment does not have and which will now be further described:

As can best be seen in FIGS. 6 and 7, the burner body 6 in the second embodiment comprises a second gas inlet 13 distinct from the aforementioned first inlet 8, arranged here in the side of the body 6, perpendicularly to the axes of the two pipes 10 and 5.

The gas inlet 13 is connectable to a gas supply via control means (not shown) which preferably are specific to it and are distinct from the supply control means of the first gas inlet 8.

It should be noted that the burner body 6 of the embodiment shown in FIGS. 1 to 5 also comprises the second gas inlet. However, the second inlet in the first embodiment is implemented as a blind hole.

It should also be noted that the shaft 12 of the burner body is not in communication with the second pipe 5 in this second embodiment.

It is therefore understood that the burner body 6 of the second embodiment and first embodiment can be achieved by machining the same basic burner body: specific machining operations are thus carried out according to whether a burner body with one or two gas inlets is desired.

In the second embodiment, the gas inlet 13 is in communication with a gas injector 14 which is oriented to be parallel to the second pipe 5 forming a Venturi tube, and therefore parallel to the first gas injector 9: in FIG. 7, the axis of the injector 14 is substantially horizontal and substantially parallel to the axes of pipes 10 and 5.

The gas injector 14 is positioned at one end of the second pipe 5 (end forming the inlet 50 of the pipe 5), opposite the outlet 51 of the pipe 5 (the outlet 51 corresponds to the opening at the top of the burner body 6).

The communication between the gas inlet 13 and the second gas injector 14 occurs via a pipe 15 penetrating through the burner body 6, visible in particular in FIG. 8.

The pipe 15 is straight and has a first end 16 opening to the gas inlet pipe 13 and a second end 17 which opens to the rear of the second gas injector 14 (see FIGS. 7 and 8).

The second gas injector 14 is positioned in a recess 18 created in the burner body 6 upstream of the second pipe 5 forming a Venturi tube.

The recess 18 of the burner body 6 is located under a second parallelepipedal portion 58 connecting the two burner heads 1 and 3, the second parallelepipedal portion 58 located in the extension of the first parallelepipedal portion 57, along the diameter of the annular outer burner head (see FIG. 7).

The second parallelepipedal portion is formed by walls connecting the concentric side wall of the annular outer burner head 3 and the peripheral wall of the central inner burner head 1. As with the first parallelepipedal portion 57, the second parallelepipedal portion 58 is open at the bottom so as to form a cover over the recess 18 formed in the burner body 6.

The recess 18 thus receives the gas injector 14 and allows the intake of primary air F1 on either side of the injector 14 under the second parallelepipedal portion 58. Thus, upstream of the second pipe 5, the burner body 6 forms a primary air intake chamber around the second injector 14 by means of the recess 18. Furthermore, due to the burner body thus created, the pipe 15 which extends the second gas inlet 13 opens into the air intake chamber adjacent to the second injector 14.

With this second embodiment, the operation of the central burner 1 and the annular burner 3 can be controlled independently.

The invention claimed is:

1. A gas burner with multiple rings of flames, suitable for mounting on a top plate of a cooking appliance in particular for household use, the top plate extending substantially in a plate plane, said gas burner comprising:

a central burner having a ring of peripheral flames and at least one annular burner having at least one ring of peripheral flames, said annular burner surrounding the central burner, and a burner body suitable for attachment to said top plate, said burner body comprising at least a first gas inlet communicating with a first gas injector situated facing a first convergent-divergent pipe forming a Venturi tube, said first pipe having an axis substantially parallel to said plate plane, said first pipe extending over at least the greater portion of a transverse extension of the burner body, said first pipe being, at its end opposite to said first gas injector, in communication with a shaft substantially perpendicular to said axis of said first pipe, said shaft being open at the top and adapted to supply said annular burner with an air/gas mixture, wherein said burner body comprises a second pipe forming a Venturi tube, its axis parallel to the axis of the first pipe and situated above said first pipe so that the second pipe is in series with the first pipe, said second pipe having one end in communication with an opening at the top of the burner body, adapted to supply said central burner with an air/gas mixture, and said second pipe comprising a second open end in said shaft, such that the air/gas mixture from said first pipe also flows in said second pipe.

2. The gas burner according to claim 1, wherein the burner body comprises a second gas inlet communicating with a second gas injector situated facing the second pipe forming a Venturi tube, the second gas injector being positioned at a second end of said second pipe forming a Venturi tube, said second end being opposite to said end in communication with the opening at the top of the burner body, said second gas injector being oriented to be parallel to said first gas injector.

3. The gas burner according to claim 1, wherein the central burner and the annular burner each respectively comprise a central burner head and an annular burner head, and respectively a central burner cap and an annular burner cap.

4. The gas burner according to claim 3, wherein the central burner head and the annular burner head are made as one part.

5. The gas burner according to claim 3, wherein the central burner head assembled to the burner body forms a passage parallel to the axis of the first and second pipes forming Venturi tubes, the passage having a passage inlet formed by the opening at the top of the burner body and a passage outlet which opens substantially into the center of the central burner head.

6. The gas burner according to claim 3, wherein the burner body comprises a second gas inlet communicating with a second gas injector situated facing the second pipe forming a Venturi tube, the second gas injector being positioned at a second end of said second pipe forming a Venturi tube, said second end being opposite to said end in communication with the opening at the top of the burner body, said second gas injector being oriented to be parallel to said first gas injector, and wherein, upstream of the second pipe forming a Venturi tube, the burner body forms, with the central burner head, an air intake chamber around said second gas injector.

7. The gas burner according to claim 6, wherein said second gas inlet opens into said air intake chamber in proximity to said second gas injector.

8. The gas burner according to claim 6, wherein the annular burner head comprises an annular chamber bordered at least unilaterally by flame outlet openings and having at its bottom an opening in communication with said shaft, and wherein the central burner head comprises a central burner chamber having an opening adapted to communicate with the opening at the top of the burner body.

9. The gas burner according to claim 1, wherein, adjacent to said at least first gas inlet, the burner body comprises an air intake opening in proximity to the inlet of said first pipe forming a Venturi tube.

10. The gas burner according to claim 1, wherein the annular burner is surrounded at the base by a downwardly inclined peripheral skirt, this peripheral skirt preferably being removable.

11. The gas burner according to claim 1, wherein it comprises at least one flame detection thermocouple and/or at least one electric ignition member, and wherein said at least one thermocouple and/or said at least one electric ignition member are operatively associated with the central burner.

12. An assembly comprising at least a gas burner according to claim 1 and a cooktop plate.

13. The assembly according to claim 12, wherein the axis of the first pipe is positioned below the plate plane of the cooktop plate, and wherein the axis of the second pipe is positioned above the plate plane of the cooktop plate.

14. The assembly according to claim 13, wherein the second pipe is enclosed between the cooktop plate on the one hand and the central burner and annular burner on the other hand.

15. The assembly according to claim 12, comprising at least one primary air intake located below the plate.

16. The gas burner according to claim 4, wherein the central burner head assembled to the burner body forms a passage parallel to the axis of the first and second pipes forming Venturi tubes, the passage having a passage inlet formed by the opening at the top of the burner body and a passage outlet which opens substantially into the center of the central burner head.

17. The gas burner according to claim 6, wherein the annular burner head comprises an annular chamber bordered at least unilaterally by flame outlet openings and having at its bottom an opening in communication with said shaft, and wherein the central burner head comprises a central burner chamber having an opening adapted to communicate with the opening at the top of the burner body.

18. The gas burner according to claim 6, wherein it comprises at least one flame detection thermocouple and/or at least one electric ignition member, and wherein said at least one thermocouple and/or said at least one electric ignition member are operatively associated with the central burner.

19. An assembly comprising at least a gas burner according to claim 7 and a cooktop plate.

* * * * *